United States Patent [19]

Focht

[11] 4,086,929

[45] May 2, 1978

[54] DOOR AND DRAIN CONTROL INTERLOCK

[75] Inventor: Ronald E. Focht, Offenburg, Baden, Germany

[73] Assignee: Hobart Corporation, Troy, Ohio

[21] Appl. No.: 739,443

[22] Filed: Nov. 8, 1976

[51] Int. Cl.[2] ..... B08B 3/02

[52] U.S. Cl. ..... 134/56 D; 134/143; 134/186; 134/200; 312/312

[58] Field of Search ... 134/56 D, 56 R, 57 DL–58 DL, 134/143, 155, 183, 186, 191, 200–201, 57 D–58 D; 137/585–586; 251/144; 312/228–229, 312; 4/198–201, 204; 222/510

[56] References Cited

U.S. PATENT DOCUMENTS

| | | | |
|---|---|---|---|
| 774,644 | 11/1904 | Blackford | 137/586 X |
| 1,238,272 | 8/1917 | Currier | 251/144 X |
| 1,559,727 | 11/1925 | Merseles et al. | 134/186 UX |
| 2,096,374 | 10/1937 | Jensen | 137/586 X |
| 2,097,661 | 11/1937 | Hammond | 251/144 X |
| 2,671,455 | 3/1954 | MacDonald et al. | 134/57 DL |
| 2,722,941 | 11/1955 | Bartlett | 134/56 D X |
| 3,122,452 | 2/1964 | Oakes | 134/155 X |
| 3,334,651 | 8/1967 | Clearman | 134/57 D X |
| 3,844,299 | 10/1974 | Athey et al. | 134/57 D |
| 3,870,067 | 3/1975 | Janiszewski | 4/201 X |

*Primary Examiner*—Robert L. Bleutge
*Attorney, Agent, or Firm*—Biebel, French & Nauman

[57] ABSTRACT

A dishwasher has a cabinet which defines a cavity, an access opening into the cavity, and a door for said opening. A washing fluid reservoir in the cabinet beneath the cavity holds washing fluid for the dishwasher. A drain for the washing fluid reservoir is manually operable between open and closed conditions when the door is open. The drain is also interlocked with a door on the cabinet which covers the access opening such that when the door is closed, the drain, if previously open, is automatically moved to its closed condition to ready the reservoir for filling. Thus, attempting to fill the reservoir with the drain open will be effectively prevented.

6 Claims, 4 Drawing Figures

DOOR AND DRAIN CONTROL INTERLOCK

BACKGROUND OF THE INVENTION

The present invention relates to dishwashers and, more particularly, to an interlock mechanism for a dishwasher which will automatically assure closure of the wash reservoir drain when the dishwasher door is closed.

The present invention relates to dishwashers of the type shown in U.S. Pat. No. 3,911,943, issued Oct. 14, 1975, to Athey et al and assigned to the assignee of this application. This type of dishwasher is used generally in a commercial environment, such as a restaurant, in which a relatively large number of dishes or other items are to be washed. The dishwasher cabinet defines an internal chamber into which racks of the items to be cleaned are placed. The lower portion of the chamber defines a reservoir into which washing fluid containing a detergent or other cleaning agent is loaded before a washing operation is begun. The dishwasher further includes a pump and spray arrangement which pumps the washing fluid out of the reservoir and sprays it onto the dishes. The washing fluid is then collected in the reservoir. This washing fluid may be used to wash a number of loads of dishes before the reservoir is drained and charged with fresh washing fluid.

During the rinse cycle, fresh water is sprayed onto the dishes by a separate rinse spray arrangement and then collects in the reservoir. A standpipe in the reservoir cooperates with the reservoir drain to insure that the fluid level in the reservoir does not exceed a predetermined level. The standpipe normally covers the drain opening in the bottom of the reservoir but may be raised to permit the reservoir to be drained completely.

The dishwasher disclosed in the Athey et al patent has a lever mounted on the exterior of the cabinet by which the standpipe may be moved into and out of engagement with the reservoir drain. If the dishwasher operator should forget to move the standpipe into its lower position and thus effectively close the reservoir drain prior to charging the reservoir with washing fluid, the washing fluid added to the reservoir would simply flow out the reservoir drain and no fluid would be available for washing the dishes.

It is clear, therefore, that a need exists for a simple, reliable interlock which will insure that the wash reservoir drain is closed when the dishwasher is operated.

SUMMARY OF THE INVENTION

A dishwasher includes a cabinet defining a cavity into which items to be cleaned are placed and an access opening communicating with the cavity. A washing fluid reservoir acts as a sump for holding washing fluid and includes a means for draining the washing fluid. A door mounted on the cabinet may be moved to cover the access opening. An interlock means is responsive to the closing of the door to close the means for draining the washing reservoir, such that washing fluid will be held in the reservoir whenever the door is closed.

The means for draining the washing fluid reservoir includes a drain means and a standpipe closure means. The standpipe closure means may be moved into a first position in which only overflow fluid in the reservoir flows into the drain, or into a second position which allows the entire reservoir to be drained.

Accordingly, it is an object of the present invention to provide an improved dishwasher having an interlock between the dishwasher door and a drain mechanism; to provide such a dishwasher in which the interlock insures that the drain is closed whenever the door is closed; and, further, to provide such a dishwasher in which a simple lost motion linkage interacts with the door during closure.

Other objects and advantages of the invention will be apparent from the following description, the accompanying drawings and the appended claims.

DETAILED DESCRIPTION OF THE PREFERRED EMBODIMENT

Figure 1:
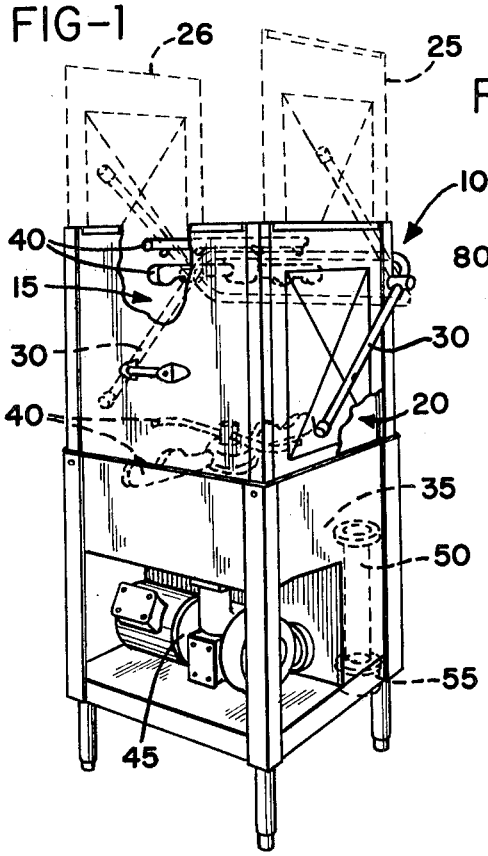
FIG. 1 is a perspective view of the dishwasher of the present invention with portions broken away and with the door closure mechanism shown in both open and closed positions.

Referring to FIG. 1, there is shown a perspective view of the dishwasher of the present invention. A cabinet 10 defines an interior cavity or washing chamber 15 into which items are placed to be cleaned. Cabinet 10 also defines one or more access openings 20 which may be covered by a closure means such as door 25. The cabinet shown in FIG. 1 is of the type used in a flow-through washing operation in which articles are inserted through one opening into the washing cavity and, after washing, are removed through a second opening. Door 26 is provided for removal of washed items and is linked to a door 25 by means of a pivoting handle mechanism 30. When either end of handle mechanism 30 is lifted, doors 25 and 26 will be raised into the position shown by the dash lines.

A washing fluid reservoir or sump 35 is provided in the bottom of the dishwasher. Washing and rinsing apparatus of standard configuration is provided to spray wash fluid and rinse fluid during the washing process. The fluid collects in the wash fluid reservoir 35 and is pumped by pump 45 which acts as a means for recirculating the wash fluid from the sump through the spray system 40. During the rinse process, clean rinse water is sprayed through spray system 40 onto the washed items. The rinse water also collects in the sump.

A standpipe mechanism 50 in reservoir 35 is provided in order to prevent excess fluid from accumulating in the reservoir during the rinse cycle. The standpipe 50 communicates with a drain means 55 and acts as a drain closure means.

Figure 3:
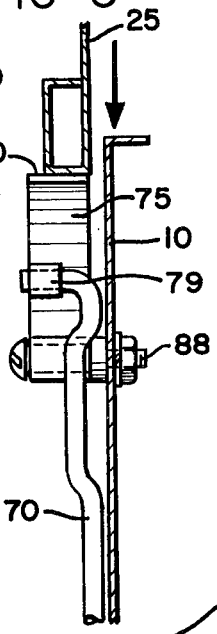
FIG. 3 is a partial sectional view of the upper portion of the interlock as seen looking generally right to left in FIG. 2.
Figure 2:
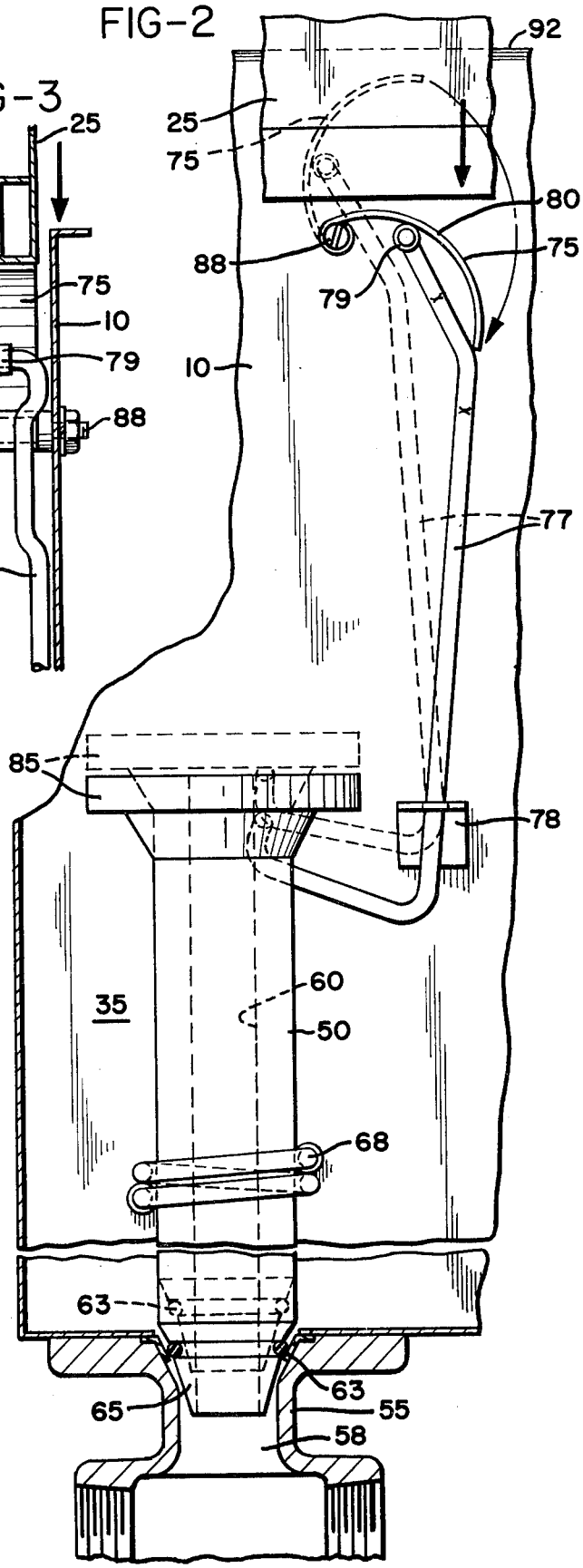
FIG. 2 is a partial sectional view through the drain mechanism as seen looking generally left to right in FIG. 1.
Figure 4:
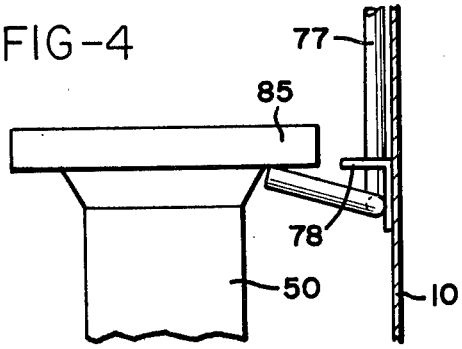
FIG. 4 is a partial sectional view showing the lower portion of the interlock, as seen looking right to left in FIG. 2.

Referring to FIGS. 2 through 4, the standpipe 50, drain 55, and an interlock means are shown in greater detail. The interlock means is responsive to the closing of the door mechanism to close the drain means and to prevent draining of the reservoir. Drain means 55 defines a drain opening 58 which communicates with standpipe mechanism 50. Standpipe mechanism 50 is movable between a first, lower position, shown by the solid lines, in which the standpipe 50 closes the drain opening 58 and a second upper position in which the opening 58 is opened. When the standpipe mechanism is in its first, lower position, fluid in the sump can flow out through drain means 55 only by flowing over the top of the standpipe mechanism and down through opening 60. As seen in FIG. 2, rubber seal 63 encircles the frustoconical portion 65 of standpipe mechanism 50 and insures a watertight seal. Wire loop 68 is fastened to the inside of cabinet 10 and holds standpipe mechanism 50 in position above drain means 55 while permitting the standpipe mechanism to move vertically.

The interlock means which is responsive to the closing of the door includes a linearly actuatable linkage means comprising first pivotal linkage means 75 and second linearly actuatable linkage means 77. Linkage 77 extends through an opening in stationary bracket 78 and may be moved vertically as shown by the dash lines in FIG. 2. As seen in FIG. 4, the lower end of linkage 77 is positioned directly beneath the lip 85 of standpipe mechanism 50 which acts as a means for engaging the standpipe mechanism 50. Upward movement of linkage means 77 results in the standpipe mechanism being moved into its second upper position in which the drain opening 58 is open to drain sump 35 completely. After the linkage means 77 is lowered, the standpipe mechanism 50 is moved into its first, closed position in which only overflow fluid will pass out through drain 55.

Linkage means 77 is pivotally attached through a loop 79 to pivotal linkage means 75 which defines an upper cam surface 80. Linkage means 75 is fastened to cabinet 10 and pivots about a bolt 88 in a lost motion cooperative relationship with door 25. When linkage means 75 is in its upper position, as shown by dashed lines in FIG. 2, an overcenter type of action will hold linkage means 77 in its raised position, consequently opening drain 55. Since linkage means 75 is positioned just below the bottom edge 92 of access opening 20, when door 25 is opened, the operator merely reaches into cavity 20 in order to move pivotal means 75 and open drain 55. The interlock is, therefore, effectively a manually operable latch means for latching the drain into an open position.

In order the curved insure that the drain opening 58 is closed at the beginning of each washing cycle, a lost motion interaction between the door 25 and linkage means 75 is provided, as illustrated in FIG. 3. As door 25 is lowered, it comes in contact with thecurved upper camming surface of linkage mean 75 and pivots linkage means 75 back over center about bolt 88 thus acting as a latch release. The door then descends into the position shown in FIG. 2, and the linkage means drops downward permitting drain 55 to close. The lost motion interaction between the door 25 and linkage means 75 permits the door to be opened between washing operations for loading and unloading cavity 15 without requiring the sump to be recharged with washing fluid after each such opening. To raise the standpipe, with the door open, the operator merely reaches through the opening and lifts the linkage 75 to the upper over center position.

It should, of course, be realized that the present invention may be implemented in a variety of ways. The lost motion connection between the door and the drain may be by way of a magnetic linkage arrangement in which lowering of the door moves magnetically coupled links apart sufficiently such that the drain will not remain latched into its open position. In other embodiments, spring latch configurations may be utilized.

While the form of apparatus herein described constitutes a preferred embodiment of the invention, it is to be understood that the invention is not limited to this precise form of apparatus and that changes may be made therein without departing from the scope of the invention.

What is claimed is:

1. A dishwasher comprising:

a cabinet defining a cavity into which items to be cleaned are placed and an access opening into said cavity, a washing fluid reservoir in said cabinet beneath said cavity for holding washing fluid for the dishwasher, means for draining said washing fluid reservoir, a door mounted on said cabinet for covering said opening, and interlock means, responsive to the closing of said door when said means for draining is open, for closing said means for draining and permitting opening of said door without affecting said means for draining.

2. A dishwasher according to claim 1 wherein said interlock means includes manually operable means within said cavity for opening said means for draining when said door is open.

3. A dishwasher comprising:

means defining a chamber into which dishes are loaded for washing and rinsing, washing and rinsing apparatus in said chamber, means defining an access opening into said chamber, door means for covering said opening during operation of the dishwasher, reservoir means in the bottom of said chamber for receiving and collecting wash and rinse fluid, a drain opening at the bottom of said reservoir means for draining said reservoir, standpipe closure means, communicating with said drain opening for closing said drain opening while permitting overflow fluid in said reservoir to flow into said drain opening through said standpipe when in a first position and for opening said drain opening and allowing the entire reservoir to be drained when in a second position, means for manually operating said standpipe closure means between said first and second positions when said door means is open, and means for moving said standpipe closure means into said first position automatically when said door means covers said opening.

4. In a washer having a wash chamber, an access opening, a door therefor, a sump for holding cleaning liquid, a liquid spray system for directing cleaning liquid onto articles in said chamber, means for recirculating said cleaning liquid from said sump through said spray system, a drain opening in the bottom of said sump, a drain closure for said drain opening movable between a first position in which said drain opening is open and a second position in which said drain opening is closed, and manually operable means for moving said drain closure between said first and second positions, the improvement in said means for moving said drain closure comprising:

means operatively interconnecting said drain closure and said door for moving said drain closure, if in its first position, to said second position in response to the closing of said door independently of operation of said manually operable means.

5. A washer according to claim 4 wherein said means operatively interconnecting said drain closure and said door comprises a lost motion connection enabling opening of said door without affecting said drain closure.

6. In a washer having a wash chamber, an access opening, a door closure means for closing said access opening, a sump for holding cleaning liquid, a liquid spray system for directing cleaning liquid onto articles in said chamber, means for recirculating said cleaning liquid from said sump through said spray system, drain means in the bottom of said sump having an open position in which said sump is drained and a closed position, and manually operable latch means for latching said drain means into said open position, the improvement in said latch means comprising:

latch release means, responsive to said door closure means closing said access opening, for releasing said latch means if said drain means is in said open position, thereby closing said drain means whenever said door closure means covers said access opening.

* * * * *